United States Patent [19]

Gunter et al.

[11] 4,301,573

[45] Nov. 24, 1981

[54] FIBER PROCESSING APPARATUS AND METHOD

[75] Inventors: Josef K. Gunter; James E. O'Neal; Thomas R. Jones, all of Durham, N.C.

[73] Assignee: Gunter & Cooke, Inc., Durham, N.C.

[21] Appl. No.: 49,147

[22] Filed: Jun. 18, 1979

[51] Int. Cl.[3] ..... D01G 9/12; D01G 15/40

[52] U.S. Cl. ..... 19/200; 19/80 R; 19/105; 19/107; 19/145.7; 19/204

[58] Field of Search ..... 19/40, 41, 80 R, 85, 19/87, 93, 98, 99, 107, 104, 205, 105, 200

[56] References Cited

U.S. PATENT DOCUMENTS

| | | | |
|---|---|---|---|
| 1,259,243 | 3/1918 | Keough | 19/87 |
| 1,694,950 | 12/1928 | Penney et al. | 19/105 |
| 2,484,604 | 10/1949 | Barnes et al. | 19/88 |
| 2,810,163 | 10/1957 | Kyame et al. | 19/205 X |
| 2,964,802 | 12/1960 | Aono et al. | 19/105 |
| 3,559,804 | 2/1971 | Lytton | 19/205 X |
| 4,040,948 | 8/1977 | Hergeth | 19/200 X |
| 4,126,914 | 11/1978 | Winch et al. | 19/104 X |
| 4,128,917 | 12/1978 | Varga | 19/105 |
| 4,253,215 | 3/1981 | Mangialardi | 19/202 X |

*Primary Examiner*—Louis Rimrodt

[57] ABSTRACT

The present invention consists of an apparatus and method whereby fibers such as cotton or otherwise are cleaned and carded prior to yarn formation to insure that the maximum quantity of fibers are utilized while removing substantially all non-lint from the fiber. Minimum fiber loss occurs while providing a sliver of excellent quality. The process herein includes the steps of carding the fibers whereby a portion of usable fibers, lint and other foreign matter are removed and are thereafter displaced to a condenser means. After condensing, the usable fibers which are still commingled with the waste are then extracted and recycled to the carding apparatus after blending with fresh stock in a uniform manner to provide a consistent blend for sliver formation or other uses.

8 Claims, 4 Drawing Figures

FIBER PROCESSING APPARATUS AND METHOD

BACKGROUND AND OBJECTIVES OF THE PRESENT INVENTION

Carding in textile mills is an old and well developed art used in processing natural and synthetic fibers. Carding allows the opening of the fibers such as cotton, completely, even to individual fibers, and it allows the cleaning of the fibers by removing the dirt, seeds, leaves, neps, unusable short fibers and other non-lint content prior to production of a sliver which is a continuous, untwisted fibrous strand formed from the fibers.

The "unusable" fibrous materials collected from conventional carding apparatus during processing may contain dirt, seeds, twigs, bits of fiber and other debris which may be commingled with a percentage of usable fibers. This "unusable waste" is usually removed from the card on a routine schedule and disposed of as trash. Over a year's time a considerable amount of usable fibers is discarded in this manner unseparated from the unusable trash. Attempts have been made to reclaim the usable fiber but prior to the present invention no practical continuous process or economical apparatus or methods have been found for this purpose.

Therefore, it is an objective of the present invention to provide an economically feasible method and apparatus for extracting fibers from carding waste and reintroducing these extracted fibers to the carding apparatus in a consistent manner, and to eliminate the emission of dust, short fiber and non-lint particles in processes subsequent to carding.

It is another objective of the present invention to provide apparatus which will remove substantially all (75%+) of the non-lint content from the fiber stock.

It is still another objective of the present invention to utilize 99%+ of the fiber stock for processing into slivers or other usable forms having optimum quality.

It is yet another objective the present invention to improve open-end and ring spinning by obtaining slivers with consistent fiber blends and minimum non-lint content.

It is also an objective of the present invention to provide carding apparatus and methods which will run efficiently and will require minimum maintenance.

DESCRIPTION OF THE PREFERRED EMBODIMENT AND DETAILED DESCRIPTION OF THE DRAWINGS

Figure 1:
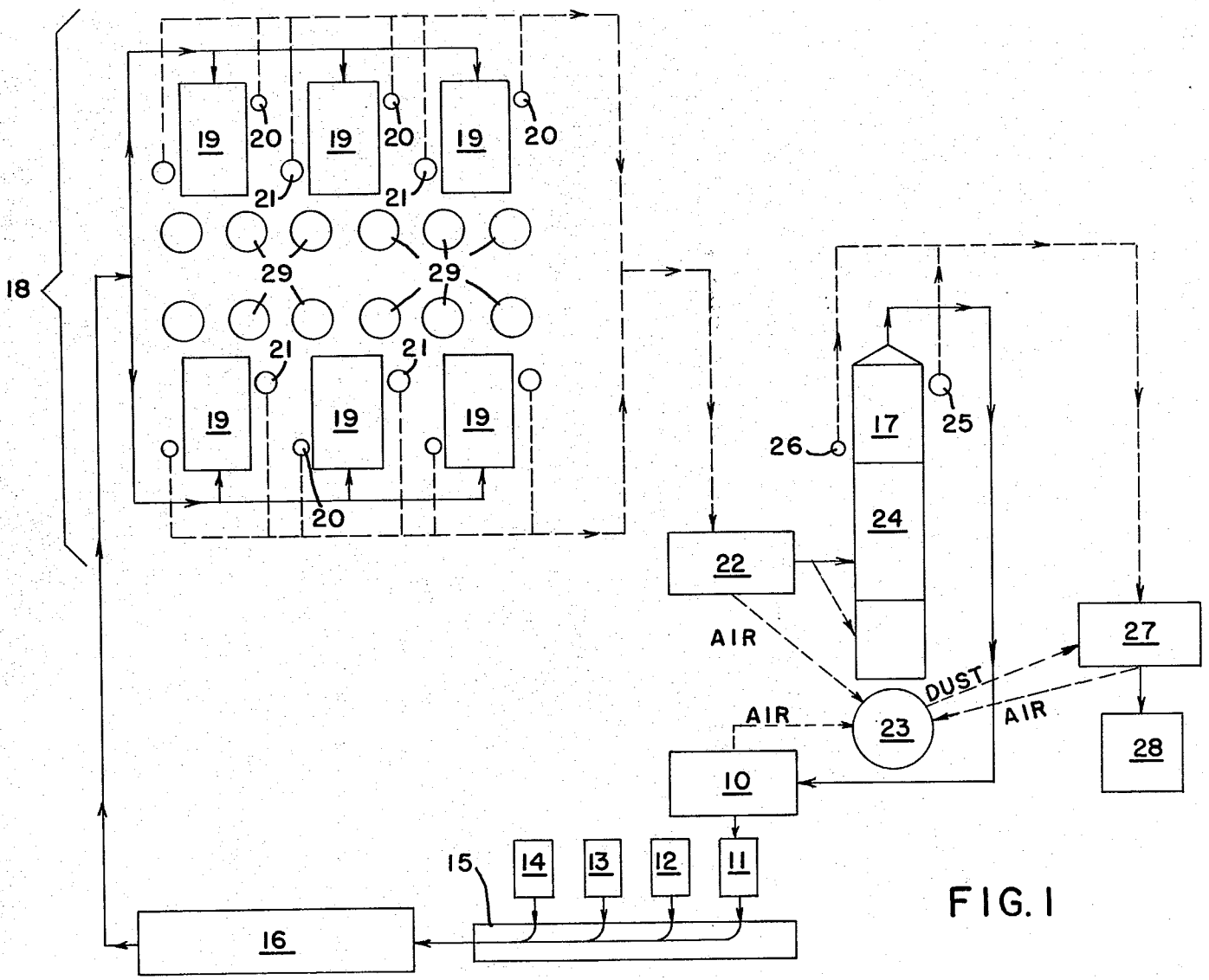
FIG. 1 is a schematic view of the apparatus utilized in the preferred embodiment of the present invention.

The preferred embodiment of the present invention is shown in schematic form in FIG. 1 having hoppers for the reception of new cotton stock or other fibers therein and recycled fiber. The fibers are directed from the hoppers to blending means and from the blending means the fibers are passed to an opening and cleaning line. The fibers or stock is then distributed to carding apparatus consisting of a plurality of individual carding machines or "cards" which by conventional methods separate the "extract" from the usable fibers and may form the usable fibers into slivers. The fiber extract from the cards is then directed to a condensing means which makes a preliminary separation of the very light trash or dust from a usable fibrous mass. From the condenser means the fibrous mass which contains a high percentage of impurities is transferred to a feed means which supplies cleaning apparatus including an extractor. The extractor makes a separation of the fibrous mass thus dividing the usable fibers from the waste materials included therein. The waste from the extractor is disposed of and the usable fibers are transferred to a hopper means for recycling and blending with new fiber stock for supplying the carding apparatus and thus beginning the processing cycle again.

It is understood that substantially all the non-lint content be removed along with a portion of usable fibers by the cards. The percentage of usable fiber removed and directed to the extractor is desirable and assists in maintaining uniformity as the extracted fiber is blended with the new stock in the opening line.

For a more detailed description of the drawings, extract stock condenser means 10 is shown in FIG. 1 which receives the recycled fiber stock which may be cotton, for example, although synthetic and other natural fibers may also be utilized in the present invention which are directed from extractor 17. Recycled fibers from extract stock condenser means 10 are then passed to hopper means 11. New stock is introduced into hopper means 12, 13, and 14 which in turn directs the fibers into blending line 15. In blending line 15 the new and recycled fibers are blended into a homogeneous mixture.

The blended fibers consisting of new fiber stock and recycled fibers are then passed from blending line 15 to opening and cleaning line 16. From opening and cleaning line 16 the fibers are passed to carding apparatus 18 which comprises a plurality of individual cards 19 which may form slivers from the received fibers.

The series of cards 18 is adjusted in an "open" fashion as will be more fully explained later herein and approximately 80 to 95% of the fiber stock received from opening line 16 is utilized in sliver production or for other purposes. The remaining 5 to 20% of the fibers (including waste) is removed for passage to extractor 17.

As further shown in FIG. 1, sliver producing cards 19 have left 20 and right 21 extract conduits through which fiber extract is directed to condenser means 22 which may include a revolving wire drum around which the extract collects in a fibrous mass. Air passing through the condenser 22 removes the very fine dust particles and other light waste matter and such light trash is removed from the air stream by air filter means 23. Dual sliver containers 29 are also shown in FIG. 1 of this the preferred embodiment.

The fibrous mass collected by condenser 22 is transferred through a conduit to feeding means 24 which supplies extractor 17 in a uniform manner to insure a continous and even output by extractor 17.

Extractor 17 is adjusted in a more "closed" fashion than are the sliver producing cards 19 and extractor 17 produces waste in an amount from 5 to 30% due to the front cylinder fibrator slot being set approximately 50% closer on the extractor 17 as are other opening settings to insure a high degree of fiber retention while still providing for waste removal by extractor 17.

Thus, while a conventional card may produce from 2–7% fiber loss and the opening and cleaning lines from 0.5–3% fiber loss, the method of the present invention produces a total fiber loss in the neighborhood of from 0 to 2%. Hence, for a particular fiber stock with the carding apparatus 18 having a maximum 20% extractables, said extractables thereafter being processed by extractor 17 which may produce from 5 to 30% waste, a total fiber loss of from 0.5 to 2% is generated based on the total fiber processed. Of course, the waste amount produced by the method of the present invention is dependent upon the non-lint content of the fiber stock employed. For example, on a particular cotton fiber stock batch, laboratory analysis determined that the total non-lint content amounted to 4.2%. At various points of the present invention the percentages of waste were determined as follows:

| Point of Test | Waste Amounts | |
|---|---|---|
| Air Filter Means | 1.21% | |
| Extractor | 2.22% | |
| Opening Means | 1.43% | |
| Total | 4.86% | |
| Non-lint content of stock | 4.20% | (by laboratory analysis) |
| Fiber Removal Total | .66% | |

As shown by the above test results the method of the present invention removes only 0.66% fiber during the process. As is understood it can be appreciated by those skilled in the carding art that this fiber loss of less than 1% is a tremendous improvement over conventional systems and devices which remove from 2 to 10% of the usual fiber. Also, the 0.66% fiber loss may include various short fibers which may not be suitable for yarn formation or other uses.

As further shown in FIG. 1, the extractor 17 is provided with two waste conduits, 25 and 26 which permit conveyance of the waste produced to a second condenser means 27. The waste collected in condenser means 27 is transported through conduits to waste receptacle 28. The usable fibers generated by extractor 17 are directed through conduits to extract stock condenser means 10 on a consistent poundage basis whereby opening line 16 is provided with a constant and uniform supply of recycled fiber. Recycled fiber is uniformly blended with the new stock in blending line 15 and this uniform blend allows the slivers produced by carding apparatus 18 to be of superior quality and allows for many advantages "downstream" in yarn and fabric production. For example, open-end yarns produced by the present invention have a greatly improved break factor. It has been found that rotors on conventional open-end spinning frames demonstrate up to a 90% reduction in residual dust accumulation due to the cleanliness of the slivers. Also, dust emissions in the mill are reduced and employee health and working conditions are improved.

In operation the consistency of the fiber blend in blending line 15 is dependent in part upon the speed by which extractor 17 runs and the blend in blending line 15 varies depending upon whether extractor 17 is run on either a high or low speed. It has been found satisfactory to have dual speeds for extractor 17 and more recycled fiber is added to blending line 15 when the extractor is run at the higher speed and less recycled fiber is added to the blend when extractor 17 runs at its lower speed, provided of course that new stock is added at a consistent rate to hoppers 12, 13, and 14. Extractor 17 incorporates control means including a sensor (not shown) in feeding means 24 which monitors the amount of extractables present and also the amount of processed fibers in hopper means 11. When the amount of stock in feeding means 24 drops below a preset minimum the control means automatically directs extractor 17 to run at its lower speed. If the stock falls below a minimum level preset for feeding means 24, then extractor 17 will shut completely off. When the supply of feeding means 24 again is replenished extractor 17 will return to a low speed "running" condition. If additional stock is received by feeding means 24 whereby a second preset minimum is reached, then the control means directs the extractor 17 to run at a second, higher speed.

Additionally, the control means for extractor 17 includes a sensor which monitors hopper 11 and if hopper 11 reaches a prescribed maximum supply of extractables, extractor 17 will either stop running or will run at its lower speed until hopper 11 depletes itself of a preset amount of available fibers.

Figures 2, 3, 4:
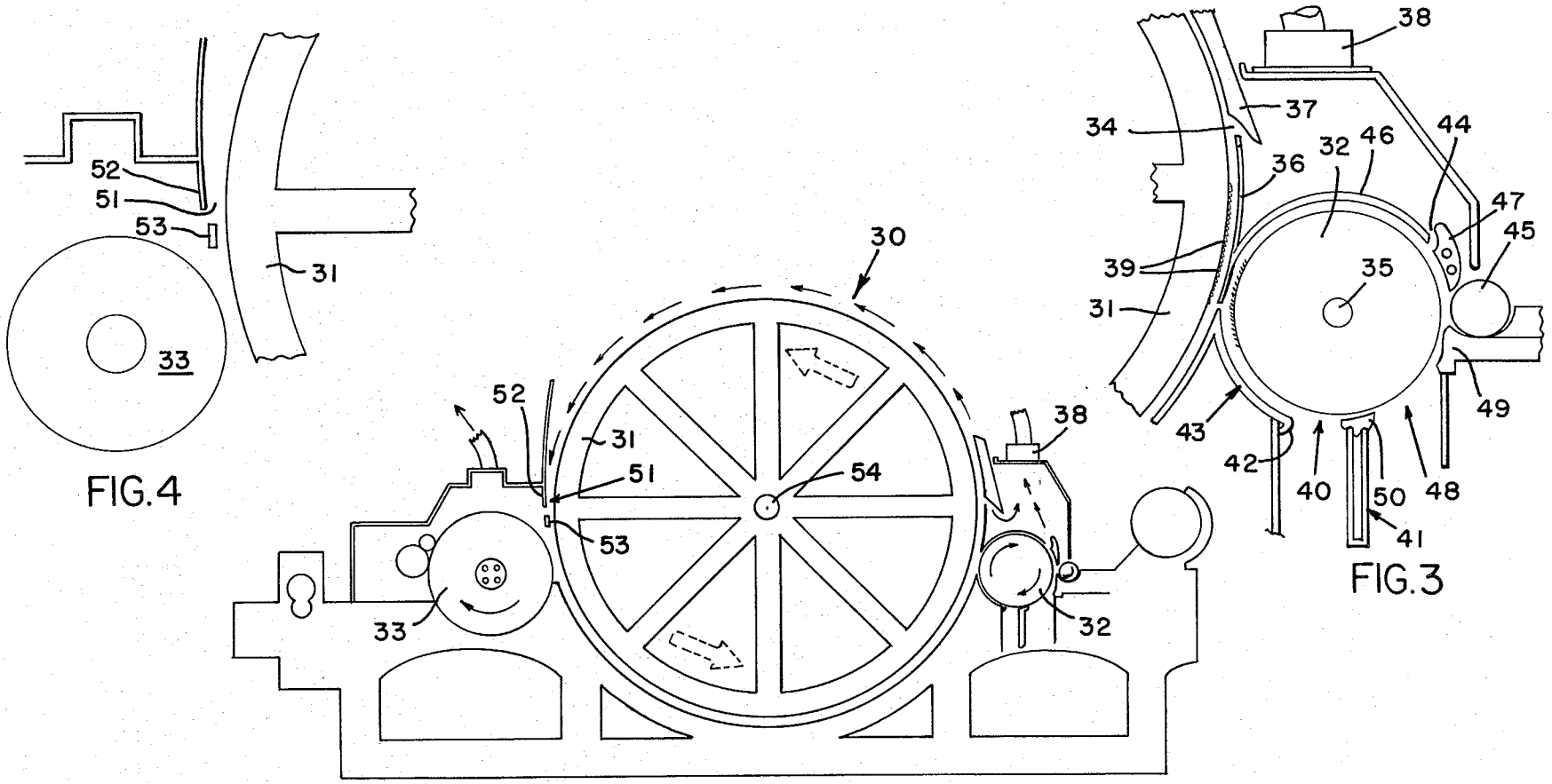
FIG. 2 is a diagram of carding apparatus as used therein.
FIG. 3 is an enlarged view of the lickerin assembly of FIG. 2.
FIG. 4 is an enlarged view of the doffer illustrated in FIG. 2.

As shown in FIG. 2, card 30 has carding cylinder 31, lickerin 32 and doffer 33. Both sliver producing cards 19 and the extractor 17 as shown in FIG. 1 are represented by card 30, however, the sliver producing cards 19 and the extractor 17 are adjusted differently to achieve different processing techniques as previously mentioned above with the settings further described below as would apply to sliver producing cards 19.

As shown in FIG. 3, opening, 34 is a horizontal slot across the full width of cylinder 31 parallel to cylinder shaft 54. The bottom of opening 34 is formed by back plate 36 and the top is formed by rear fibrator baffle 37. The width of opening 34 is adjustable from a minimum width opening of 0.5 inches to a maximum width opening of 1.25 inches. Back plate 36 is set a sufficient distance away from cylinder 31 (0.088 to 0.125 inches) to allow the air generated by the rotating lickerin 32 and cylinder 31 to be exhausted. The back fibrator baffle 37 is set close to cylinder 31 (0.010 to 0.034 inches) and due to the overlapping configuration of baffle 37 the air approaching slot 34 from beneath back plate 36 is reversed and due to the low pressure in the surrounding air, dust and fine particles of trash are removed through plenum 38 while the "cleaned fibers" are seated against the metallic wire teeth 39 shown in FIG. 3 on cylinder 31.

Below lickerin 32 opening 40 is illustrated between stripper bar 41 and leading edge 42 of lickerin screen 43. Opening or slot 40 extends the width of lickerin 32 and is parallel to lickerin shaft 35. The slot width is approximately 1.5 inches as shown in FIG. 3 and the rear edge of stripper bar 41 is adjustable from the lickerin at a distance of 0.030 inches to 0.250 inches. The leading edge of lickerin screen 42 is adjustable to the lickerin from a distance of 0.010 to 0.250 inches. A conventional setting of these components would be a setting of 0.090 inches between the rear of stripper bar 41 and lickerin 32 and approximately 0.010 inches between the nose or leading edge 42, of lickering screen 43, and lickerin 32.

Slot or opening 44 is shown on the upper side of lickerin 32 above feed roll 45 and is formed by the rear edge of the lickerin bonnet 46 and the fibrator baffle 47. Opening 44 is adjustable from 0.125 to 1 inches. Lickerin bonnet 46 is raised a distance from the high speed surface of lickerin 32 to allow the passage of air from rotating lickerin 32. Fibrator baffle 47 is set close to the surface lickerin 32, approximately 0.015 to 0.034 inches.

Opening 48 is shown in FIG. 3 below lickerin 32 between feed plate 49 and nose 50 of stripper bar 41. This slot or opening extends the width of lickerin 32 and is parallel to shaft 35. By installing different lengths of stripper bars 41, different results are achieved and a long stripper bar is used when the minimum fiber loss is desired and conversely a short stripper bar is utilized when maximum waste removal is desirable.

FIG. 4 presents an enlarged view of the doffer 33 and opening 51 between front plate 52 and cylinder 31. Front plate 52 is set approximately 0.040 to 0.060 inches away from cylinder 31 and front fibrator baffle 53 is set close to cylinder 31 at a distance of from 0.010 to 0.030 inches. Similar air currents and reversals take place thereabouts as described in more detail pertaining to slot 34.

For a more general understanding of the openings described above and their particular functions, it should be understood that various types of foreign matter are present in all fibers, even in virgin cotton. For example, microdust and extremely fine, loose particles of seeds, leaves, stems, along with dirt, sand and other contaminates are contained therein. Large particles of seeds and stems and fine and large particles of seed husks attach themselves to the fibers and must be removed prior to sliver formation. In general, opening 48 shown in FIG. 3 allows for the removal of heavy particles of foreign matter contained in fibers such as seed and stem components. Opening 40 as shown in FIG. 3 allows for the removal of lighter weight foreign matter such as dust and fine particles of contaminates.

Opening 44 and opening 34 are utilized in the removal of dust and the finer unattached particles of foreign matter and opening 34 and 51 are the significant removal points for microdust and other extremely fine particles.

Foreign matter which is attached or which adheres to the fibers most tenaciously is generally not removed by openings 34, 40, 44 or 48. However, during the carding action these fine, attached foreign particles are separated from the fiber and removed later in the processing through opening 51.

Centrifugal, pneumatic, gravitational and mechanical forces are used to separate and remove the foreign matter from the fiber stock and the principal force utilized at openings 40 and 48 are centrifugal whereas the principal force utilized at openings 34, 44 and 51 is pneumatic. Opening 48 also utilizes a high degree of mechanical action for separating the heavy foreign particles from the fiber stock. Gravitational force is also used at slots 48 and 40.

As shown in the schematic view of FIG. 1, sliver producing cards 18 would have openings 34, 40, 44, 48, and 51 set for maximum trash removal whereby the extractor 17 would have the same openings in a more closed configuration to prevent fiber loss. Optimum centrifugal, pneumatic and mechanical forces generated assure effective trash and foreign matter removal.

The descriptions and drawings of the present invention are for illustrative purposes only and are not intended to limit the scope of the present invention.

We claim:

1. A system for processing incoming fiber stock having lint content of usable and unusable fibers and non-lint impurities comprising: carding apparatus for processing fiber stock of usable and unusable fibers and non-lint impurities, said carding apparatus adapted to produce for subsequent processing the majority of fiber stock received and for removing during fiber stock processing substantially all non-lint impurities of said stock and quantities of usable and unusable fibers, fiber conveyor means for receiving and conveying usable and unusable fibers and non-lint impurities from said carding apparatus, an extractor means displaced from said carding apparatus for processing and separating said removed usable and unusable fibers and non-lint impurities recovered from said carding apparatus and received from said fiber conveyor means into usable fibers for recycling, and unusable fiber portions and non-lint impurities for waste, waste collecting means for said unusable fiber portions and non-lint impurities, and extractor stock condenser means for receiving usable fibers from said extractor means for recycling by blending with additional incoming fiber stock supply.

2. A system for processing fibers as claimed in claim 1, and including condenser means for receiving the removed content of usable and unusable fibers and non-lint impurities from said carding apparatus to form a fibrous mass prior to conveyance thereof to said extractor means.

3. A system for processing fibers as claimed in claim 1, wherein said carding apparatus includes a plurality of individual cards, each of said cards having associated therewith sliver receiving receptacles for storing sliver, and a conduit on each card for receiving and conveying fiber extract having usable and unusable fibers and non-lint impurities to said extractor means.

4. A system for processing fibers as claimed in claim 1, wherein a condenser means for receiving fiber extract of usable and unusable fibers and non-lint impurities from said carding apparatus communicates with and receives said fibers and impurities from said fiber conveying means to form a fibrous mass for conveyance to said extractor means.

5. A system for processing fiber stock having usable and unusable fibers and non-lint impurities comprising: fiber opening means, hopper means for receiving fiber stock to be processed, said hopper means communicating with said fiber opening means, said opening mass communicating with a plurality of cards to supply fiber stock thereto containing usable and unusable fibers and non-lint impurites, said cards adapted to produce for subsequent processing the majority of fibers received and for removing a maximum of impure stock containing usable and unusable fibers and non-lint impurities separate from sliver produced on each of said cards, said impure stock of usable and unusable fibers and non-lint impurities being collected from each of said cards, condenser means communicating with said plurality of cards for receiving impure stock of usable and unusable fibers and non-lint impurities from said cards and in spaced relation thereto, feed means communicating with said condenser means for receiving a fibrous mass from said condenser means, an extractor means for processing said fibrous mass containing usable and unusable fibers and non-lint impurities from said feed means, said extractor means processing said fibrous mass received from said feed means into usable fibers for recycling, and collecting unusable fiber portions and non-lint impurities as waste.

6. A system for processing fibers as claimed in claim 5, wherein said extractor means is in communication with said hopper means whereby usable fibers discharged from said extractor means from said fibrous mass will be conveyed to said hopper means for recycling of usable fibers with fiber stock discharged from said hopper means into said fiber opening means.

7. A system for processing fibers as claimed in claim 5, wherein said extractor means includes a carding apparatus for processing said fibrous mass of usable and unusable fibers and non-lint impurities whereby usable fibers are extracted separate from unusable fibers and non-lint impurities for conveyance to said hopper means for recycling and commingling with fiber stock introduced into said fiber opening means.

8. A process for continuously treating fiber stock to remove dust and finer unattached particles of foreign matter including microdust and other extremely fine particles comprising the steps of; delivering fiber stock containing usable and unusable fiber and non-lint materials to a blending means, passing said fiber stock from said blending means to opening and cleaning means, directing said fibers from said opening and cleaning means to a carding apparatus, forming sliver from said carding apparatus and collecting said sliver, collecting and conveying for additional processing usable and unusable fibers and non-lint materials by condensing same into a fibrous mass, transferring said fibrous mass of usable and unusable fibers and non-lint materials and fine trash particles from a condenser, introducing said fibrous mass of usable and unusable fibers and non-lint materials into a feeding means, carding said fibrous mass from said feeding means to form a mass of usable fibers for recycling and removing unusable fibers and non-lint materials forming waste portions, and recycling said usable fibers by blending said usable fibers with additional supplied fiber stock.

* * * * *